United States Patent [19]

Iizuka et al.

[11] Patent Number: 4,872,312

[45] Date of Patent: Oct. 10, 1989

[54] GAS TURBINE COMBUSTION APPARATUS

[75] Inventors: Nobuyuki Iizuka, Hitachi; Kazuhiko Kumata, Katsuta; Michio Kuroda, Hitachi, all of Japan

[73] Assignee: Hitachi, Ltd., Tokyo, Japan

[21] Appl. No.: 27,730

[22] Filed: Mar. 19, 1987

[30] Foreign Application Priority Data

Mar. 20, 1986 [JP] Japan ..... 61-60575

[51] Int. Cl.[4] ..... F23R 3/54; F23R 3/06

[52] U.S. Cl. ..... 60/760; 60/754

[58] Field of Search ..... 60/754, 755, 757, 759, 60/760

[56] References Cited

U.S. PATENT DOCUMENTS

| | | | |
|---|---|---|---|
| 2,716,330 | 8/1955 | Way | 60/760 |
| 4,339,925 | 7/1982 | Eggmann et al. | 60/757 |
| 4,362,500 | 12/1982 | Eriksson et al. | 60/760 |

FOREIGN PATENT DOCUMENTS

| | | | |
|---|---|---|---|
| 161560 | 11/1985 | European Pat. Off. . | |
| 203431 | 3/1986 | European Pat. Off. . | |
| 2836539 | 2/1980 | Fed. Rep. of Germany . | |
| 3117515 | 4/1982 | Fed. Rep. of Germany . | |
| D177231 | 10/1963 | U.S.S.R. . | |
| 200964 | 12/1968 | U.S.S.R. | 60/757 |
| 2087066 | 5/1982 | United Kingdom . | |

*Primary Examiner*—Louis J. Casaregola
*Assistant Examiner*—Timothy S. Thorpe
*Attorney, Agent, or Firm*—Antonelli, Terry & Wands

[57] ABSTRACT

A gas turbine cooling apparatus is disclosed in which a flow sleeve is provided to surround a combustor liner and a tail pipe substantially over their full length. A group of small holes for impinge-cooling an outer wall of the tail pipe are formed in a region of the flow sleeve close to a turbine. Further, opening portion for introducing cooling air are provided closer to the combustor liner than the small holes. Thus, the outer wall of the tail pipe and the wall of the combustor liner are cooled by the cooling air flowing between the tail pipe, the combustor liner and the flow sleeve.

1 Claim, 8 Drawing Sheets

GAS TURBINE COMBUSTION APPARATUS

BACKGROUND OF THE INVENTION

The present invention relates to a gas turbine combustion apparatus. More particularly, it relates to a cannula type gas turbine combustion apparatus in which walls of a combustor liner and a tail pipe are cooled by using compression air.

As described in U.S. Pat. No. 3,652,181, a conventional cooling structure for a gas turbine combustor tail pipe includes a cooling sleeve provided at a part of the combustor tail pipe. A jet of cooling fluid impinges against a tail pipe surface through a plurality of holes formed in the cooling sleeve, thus cooling the tail pipe wall. Then, the fluid that has cooled the wall is joined into the primary blow gas through through-holes formed in the downstream portion of the tail pipe.

In order to enhance an efficiency of the gas turbine, it would be most expedient to increase the combustion temperature.

However, the flow rate of the air that is the cooling fluid is limited. Corresponding to the increase of the combustion temperature, the cooling of the combustor liner and the combustor tail pipe would be insufficient. For this reason, there has been a strong demand to provide a high efficiency cooling system for the combustor liner and the combustor tail pipe.

According to the prior art, since a part of air is consumed for cooling the combustor tail pipe, the air flow rate to be used for cooling the combustor liner is decreased, so that it would be impossible to further elevate the combustion temperature. Also, after the cooling of the tail pipe, the cooling air to be joined into the primary gas flow is introduced into the turbine under a two-stratified condition of the high temperature primary gas flow and the low temperature cooling air flow. This would adversely affect static and moving vanes of the turbine. Furthermore, since the cooling sleeve causes the increase of the cooling effect, the cooling sleeve is secured to the combustor tail pipe by welding but a thermal stress caused by the temperature difference between the combustor tail pipe and the cooling sleeve would be enlarged. This would be a factor of deterioration in reliability.

The conventional cooling sleeve type apparatus is constructed so that the air jets supplied through the holes formed in the cooling sleeve are introduced into the primary gas flow through the through-holes of the tail pipe after the impingement against the tail pipe wall. Accordingly, a pressure difference for allowing the cooling fluid to flow is needed between the insides and outsides of the cooling sleeve and the tail pipe. To generate the pressure difference, it is necessary to increase a pressure loss of the combustor portion. This requirement would lead to a reduction in operational efficiency of the gas turbine.

Furthermore, in the case where a part of the cooling fluid is consumed for cooling the combustor tail pipe to keep constant the temperature of combustion, a temperature distribution or gradient [=(maximum combustion temperature−mean combustion. temperature)/(mean combustion temperature−cooling air temperature)]-would be adversely affected in addition to the introduction of the cooling air into the tail pipe outlet. This degradation in temperature gradient would cause "high spots" of the metal temperature in the static and moving vanes of the turbine, which would be a cause of damage to the turbine.

In the gas turbine, the outlet air supplied from the compressor is introduced into a combustion chamber defined by the combustor liner and the tail pipe and is fed to the combustor liner while cooling the combustor liner and the tail pipe for combustion.

In the foregoing prior art, the cooling fluid that has been introduced from the plurality of holes formed in the cooling sleeve mounted at the downstream end of the tail pipe is joined into the primary gas through the through-holes formed in the wall of the tail pipe after the cooling fluid has impinged against the outer wall of the tail pipe to cool the wall. The consumption of part of the cooling fluid for cooling the combustor tail pipe means a corresponding decrease of the amount of the cooling fluid supplied to cool the combustor liner. Accordingly, it would be impossible to maintain the metal temperature of the combustor liner below an allowable temperature. Thus, it is necessary to decrease the combustion temperature.

Moreover, in order to make the cooling fluid flow through the cooling sleeve into the tail pipe at a predetermined flow rate, it is necessary to impart a pressure difference between the outside of the cooling sleeve and the inside of the tail pipe. Correspondingly, the efficiency of the gas turbine would be reduced.

SUMMARY OF THE INVENTION

An object of the invention is to provide a gas turbine combustion apparatus which is capable of introducing almost all of cooling fluid, that has been used for cooling a tail pipe, into a combustor liner as a combustion air, thus improving an efficiency of a turbine and suppressing a temperature of the combustor pipe metal below an allowable temperature.

This and other objects are attained by providing a gas turbine combustion apparatus wherein a flow sleeve is provided over a circumference of the combustor tail pipe outer wall in spaced relation therefrom, and this flow sleeve is utilized for cooling the tail pipe, whereby a retainer ring portion of the tail pipe is used for convection cooling by the cooling fluid that has been introduced from an opening formed at a downstream end of the flow sleeve, a downstream portion where a flow rate of the primary gas flow within the tail pipe is high and a metal temperature of the tail pipe is high is used for impingement cooling by jets of the cooling fluid supplied from a plurality of holes formed in the flow sleeve, and a region upstream of the downstream portion, where the metal temperature is relatively low, is used for convection cooling by flowing the cooling fluid between the tail pipe and the flow sleeve at a predetermined flow rate.

In a combustion apparatus in accordance with the present invention, the cooling fluid supplied from the compressor is introduced into the flow sleeve through opening portions formed at a boundary portion between the impingement cooling and the convection cooling and the plurality of holes formed for impingement cooling. Respective flows of cooling fluid are joined together and are advanced to the upstream side to be introduced into the combustor liner side. Then, the cooling air flowing into the combustor liner side is introduced into the combustor liner in response to a desired distribution ratio from dilution air holes, combustion air holes, a swirler and cooling air holes formed in the combustor liner. An air guide is provided in the flow sleeve located outside of the combustor liner so that the flow of air supplied from the dilution air holes that affects the temperature gradient is smoothly introduced.

DESCRIPTION OF THE PREFERRED EMBODIMENTS

Figure 1:
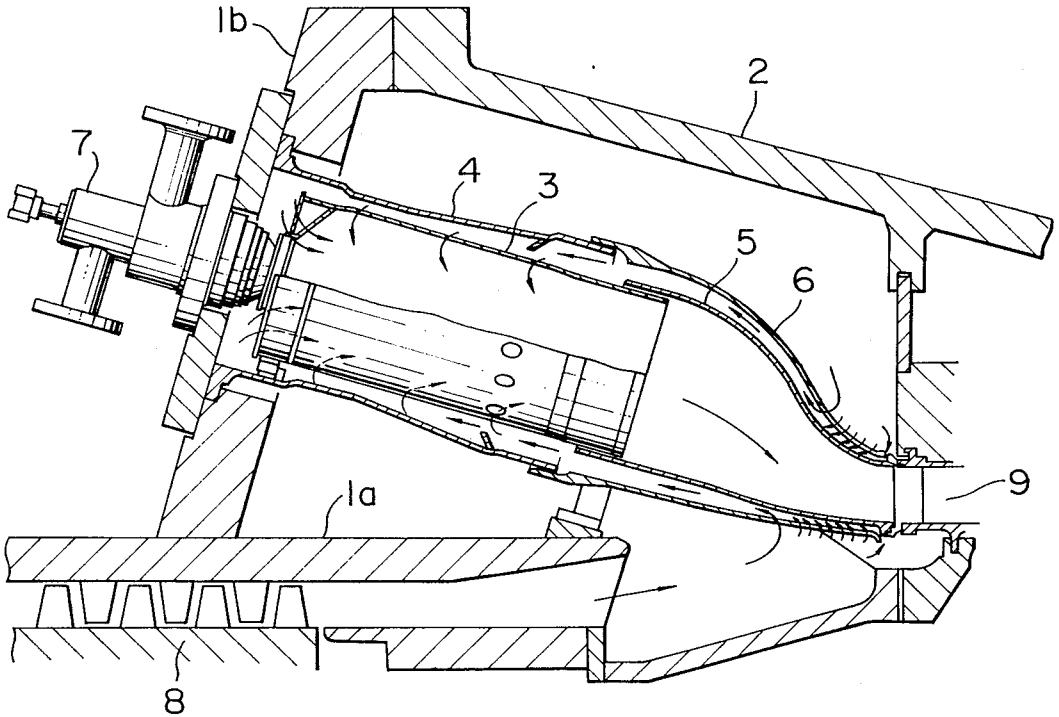
FIG. 1 is a cross-sectional view showing a combustion chamber to which a gas turbine combustion apparatus in accordance with one embodiment of the invention is applied.

A combustion apparatus for a gas turbine in accordance with the present invention will now be described with reference to the accompanying drawings.

A chamber of the combustion apparatus of the gas turbine is defined by a plurality of combustor liners 3, flow sleeves 4 for the combustor liners 3, tail pipes 5, flow sleeves 6 for the tail pipes 5, and fuel nozzles 7 in a compartment surrounded by compressor discharge casings 1*a* and 1*b* and a turbine casing 2.

Discharge air from the compressor 8 enters between the tail pipe 5 and the tail pipe flow sleeve 6 through openings formed in the tail pipe flow sleeve 6, flowing on the upstream side while cooling the tail pipe 5. The air is guided along the flow sleeve 4 for the combustor liner 3 and is introduced into the combustor liner 3.

Figure 2:
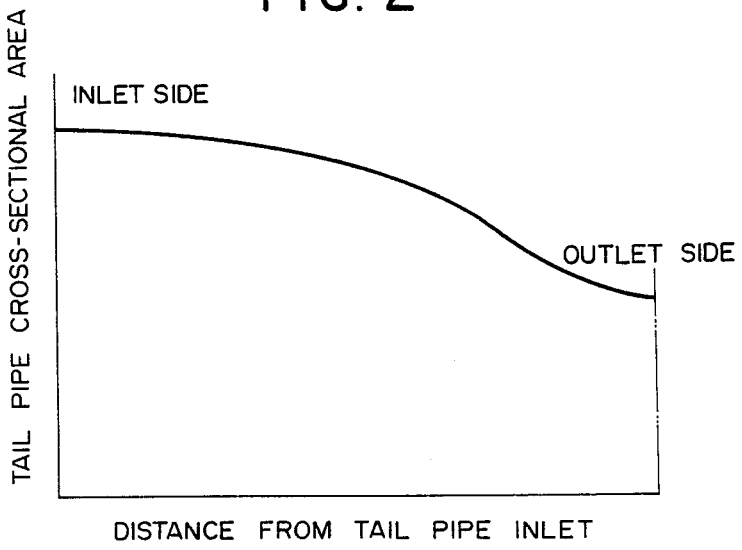
FIG. 2 is a graph showing a cross-sectional area change of the gas turbine combustor tail pipe shown in FIG. 1.
Figure 3:
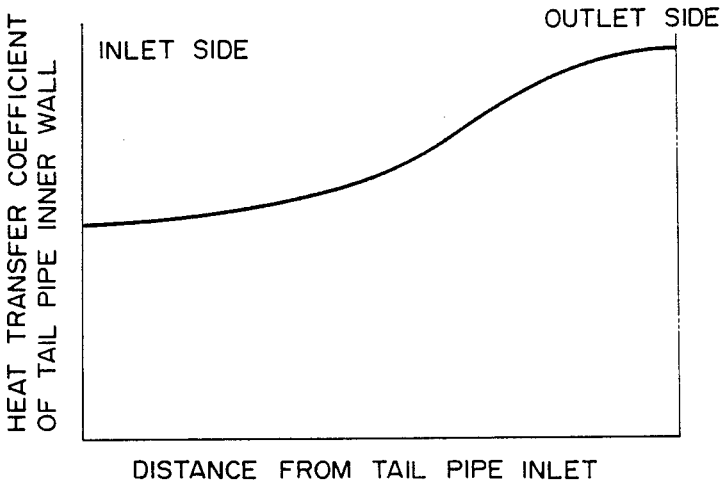
FIG. 3 is a graph showing a heat transfer coefficient change within the gas turbine combustor tail pipe shown in FIG. 1.

Fuel that has been replenished from the fuel nozzle 7 is burnt within the combustor liner 3. As a result, a high temperature gas is led to a turbine 9 through interiors of the combustor liner 3 and the tail pipe 5. The tail pipe 5 serves as a transition member between the combustor liner 3 and the turbine 9. Therefore, the tail pipe 5 is a three-dimensional shape which is continuous between a circular shape of a connected portion with the combustor liner 3 and a sector shape of a mount portion of the turbine 9. Thus, a cross-section of the tail pipe 5 is reduced from the combustor liner 3 side to the turbine 9 side as best shown in FIG. 2. As a result, the flow rate of the primary gas within the tail pipe 5 is largely changed due to the change in cross-section shown in FIG. 2 and the change in orientation of the shape of the tail pipe 5. This flow rate change will affect a heat transfer coefficient with respect to a wall surface of the tail pipe 5. A positional relationship between the heat transfer rate and the tail pipe 5 is shown in FIG. 3. Such heat transfer coefficient change will lead to change of a wall metal temperature of the tail pipe 5.

In comparison with the upstream side of the tail pipe 5, the downstream side metal temperature is high, and hence, a cooling effect must be increased therein.

Figure 4:
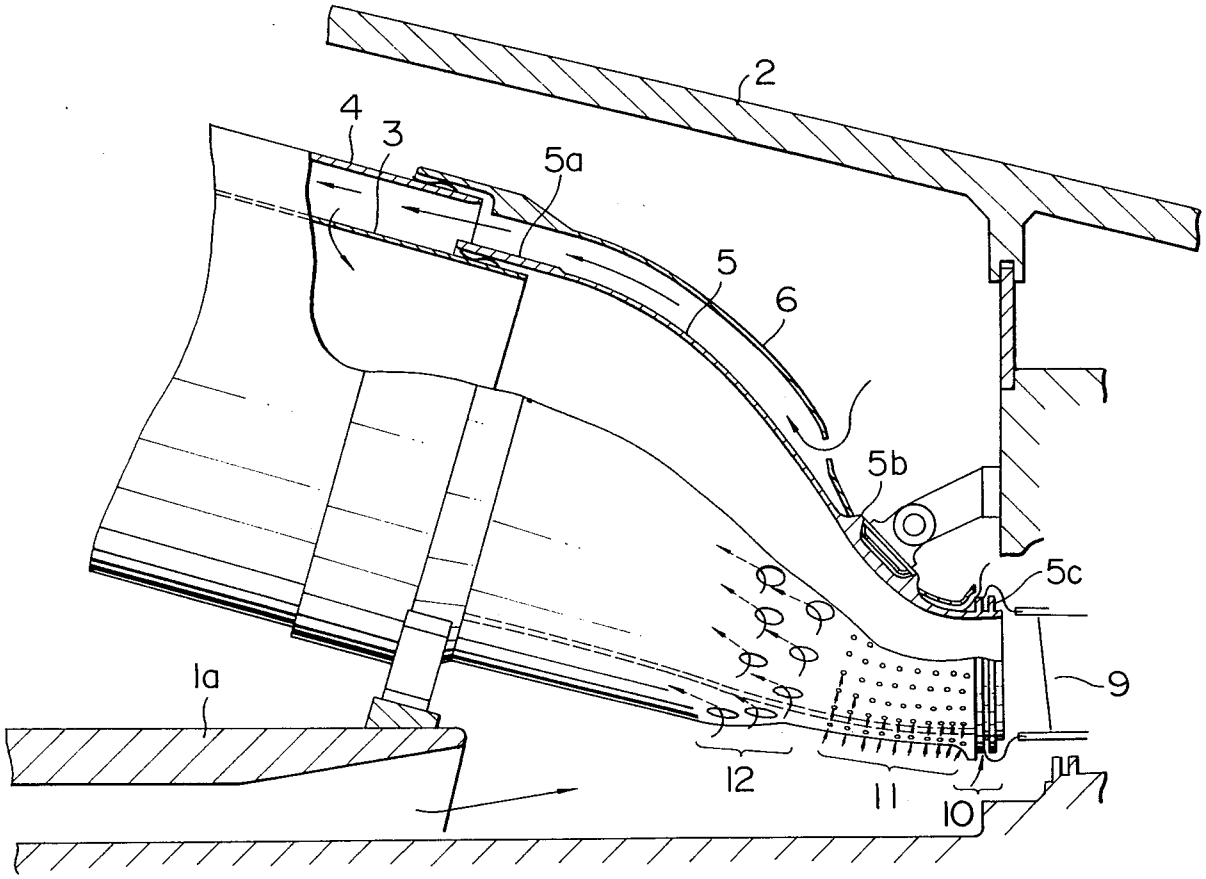
FIG. 4 is an enlarged view of the tail pipe and associated parts of the gas turbine combustion apparatus shown in FIG. 1.

FIG. 4 shows details of the tail pipe 5 within the combustion chamber shown in FIG. 1. The tail pipe 5 is composed of a ring 5*a* positioned at the press-fit portion of the tail pipe with the combustor liner 3, a retainer ring 5*c* that has a relatively large thickness for preventing a deformation of an outlet portion confronting the turbine 9, and a tail pipe body between the ring 5*a* and the retainer ring 5*c*. The cooling structure for reducing the metal temperature of the tail pipe 5 below an allowable temperature will now be described with reference to FIG. 4.

The cooling fluid from the compressor 8 will enter between the tail pipe 5 and the tail pipe flow sleeve 6 from an opening 10, a group of small holes 11 and openings 12 of the tail pipe flow sleeve 6 in order to cool the tail pipe 5. To cool the retainer ring 5*c*, the opening 10 of the flow sleeve 6 allows the cooling fluid to flow along side surfaces of the retainer ring 5*c*.

The group of small holes 11 of the flow sleeve 6 is formed in a range where the primary gas flow within the tail pipe 5 is high, and in particular in a range where the wall metal temperature of the tail pipe 5 is high. In such a range, the gap between the tail pipe 5 and the tail pipe flow sleeve 6 is reduced. Such structure is considerably available for cooling due to the combination of an impingement cooling that impinges the cooling fluid ejected through a plurality of injection holes arranged in the flow sleeve 6 and of the convection cooling that occurs when the cooling fluid from the opening 10 flows to the upstream side. The opening portion 12 of the flow sleeve 6 is formed for the purpose of introducing into the flow sleeve 6 the overall amount of the rest of the cooling fluid that is necessary for cooling the tail sleeve 5 from the openings 10 and the group of the holes 11. The cooling fluid that has been introduced from the opening 12 is joined into the cooling fluid that has been introduced from the openings 10 and the group of the small holes 11, and will flow to the upstream side between the tail pipe 5 and the flow sleeve 6. The tail pipe 5 in this range is cooled by convection of the flow, so that the tail pipe wall metal temperature may be less than the allowable temperature.

Figure 5A:
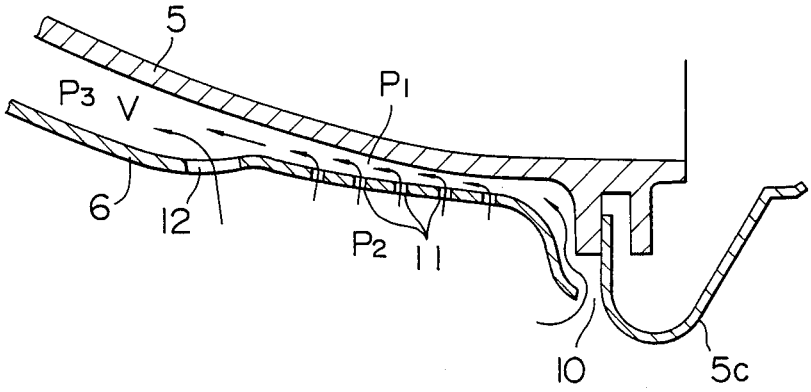
FIGS. 5A and 5B show a pressure distribution in the vicinity of the tail pipe flow sleeve opening of the gas turbine combustion apparatus shown in FIG. 4.
Figure 5B:
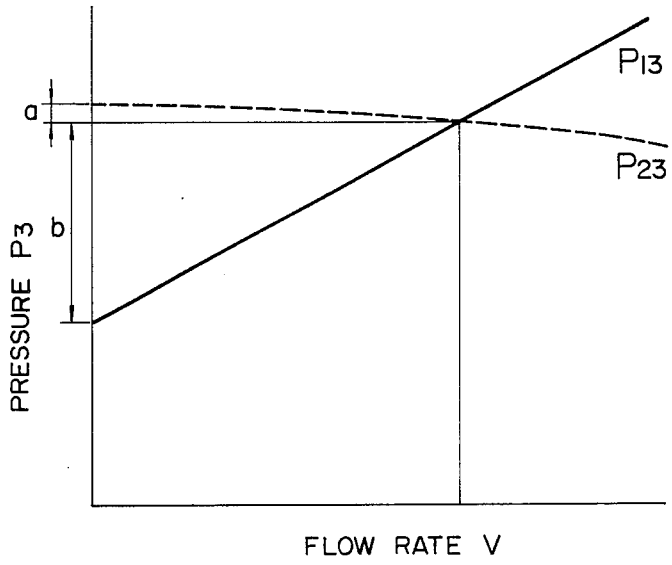

FIGS. 5A and 5B are illustrative of the pressure relationship at each part in the case where the distribution of the cooling fluid for cooling the tail pipe 5 is shown in FIG. 4.

Suppose that the pressure prior to the opening 10 of the flow sleeve 6 be represented by $P_2$, the internal pressure inside the openings 11 be represented by $P_1$, and the pressure inside the openings 12 be represented by $P_3$. Also, suppose that the flow rate of the cooling fluid downstream of the openings 12 be represented by V. $P_2$ corresponds to the outlet pressure of the compressor 8. In FIG. 5B, the relationship between the differential pressure between the pressure $P_2$ and the pressure of $P_3$ and the flow rate V of the cooling fluid is represented by dotted lines $P_{23}$. Also, the cooling fluid will flow through the small holes 11 in response to the differential pressure between the pressures $P_2$ and $P_3$. The cooling fluid from the small holes 11 flows on the upstream side of the combustion chamber within the flow sleeve 6 and joins with the cooling fluid that has been introduced through the openings 12. The relationship between the flow rate V of the cooling fluid and the differential pressure Phd 1 and $P_3$ is represented by a solid line $P_{13}$. The pressure $P_{13}$ shows the restoration from the pressure $P_1$ to the pressure $P_3$ due to the "eductor effect" of the flow rate V of the cooling fluid.

As a result, a pressure loss in this structure is shown by a in FIG. 5B and is considerably reduced in comparison with a pressure loss b in the case of the impingement cooling and the flowing of the fluid into the tail pipe 5 in accordance with the prior art.

Therefore, according to the present invention, it is possible to flow the cooling fluid in an optimum distribution without any pressure loss, so that the wall metal temperature of the tail pipe 5 is less than the allowable level.

Figure 6:
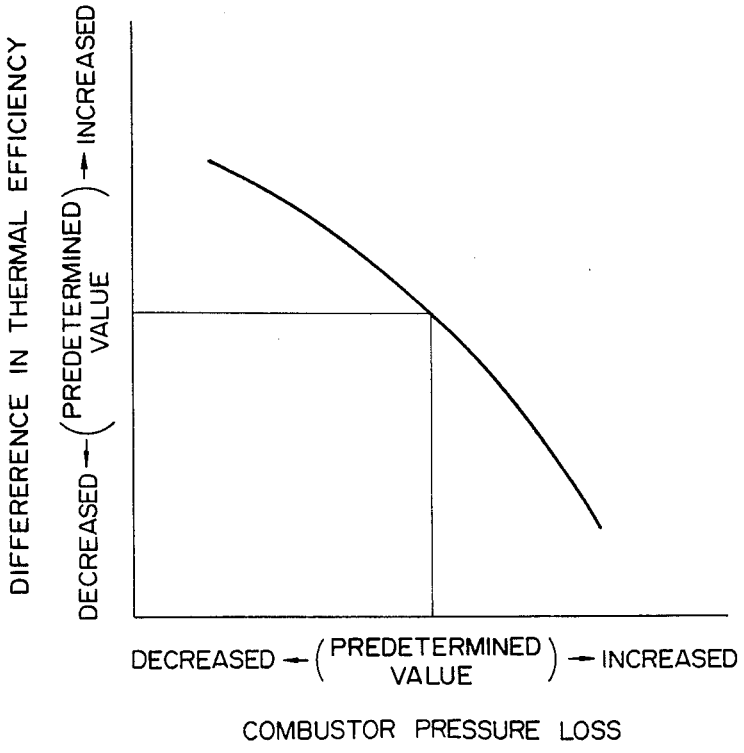
FIG. 6 is a graph showing a relationship between the pressure loss and the thermal efficiency difference in the gas turbine combustion apparatus.

FIG. 6 shows a relationship of a magnitude of the gas turbine thermal efficiency difference and the magnitude of the combustor pressure loss. In general, the pressure loss of 1% of the combustor pressure would correspond to 0.2% of the thermal efficiency of the gas turbine. In comparison with the conventional method, such effect is enhanced exceeding such level in accordance with the present invention.

Figure 7:
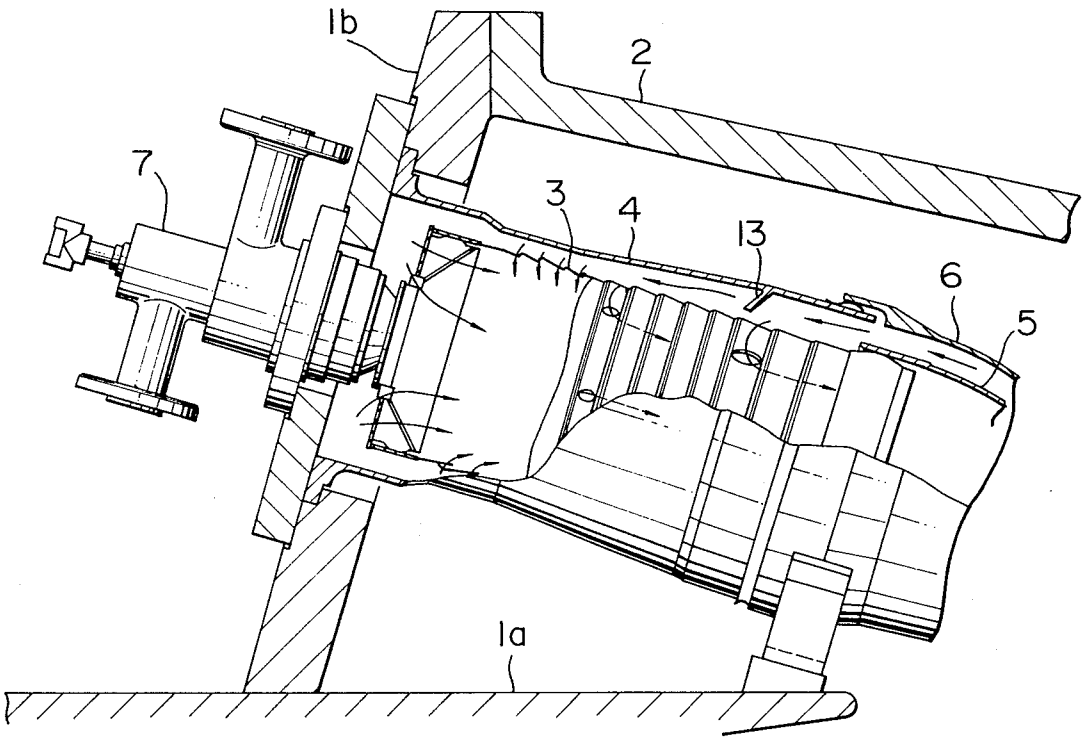
FIG. 7 is an enlarged view showing the combustion liner and associated parts of the gas turbine combustion apparatus shown in FIG. 1.

FIG. 7 shows details of the combustor liner within the combustion chamber shown in FIG. 1.

The cooling air flowing between the tail pipe 5 and the flow sleeve 6 is guided by the combustor liner flow sleeve 4, flowing upstream while cooling an outer periphery of the combustor liner 3, and will enter the combustor liner 3 through the cooling holes, diluting air holes, and combustion air holes.

A diluting air guide plate 13 is provided in the combustor liner flow sleeve 4. The diluting air guide plate 13 serves to flow the cooling fluid from the diluting air holes smoothly. As a result, the temperature unevenness will be improved in the combustor liner 3 and thus, a reliability of the turbine may be enhanced to a large extent.

Also, in the case where all of the cooling fluid is not made to flow for cooling the tail pipe but a part of the cooling fluid is bypassed to flow directly through the combustor liner, it is possible to smoothly control the air distribution and the flow of the cooling fluid.

Figure 8:
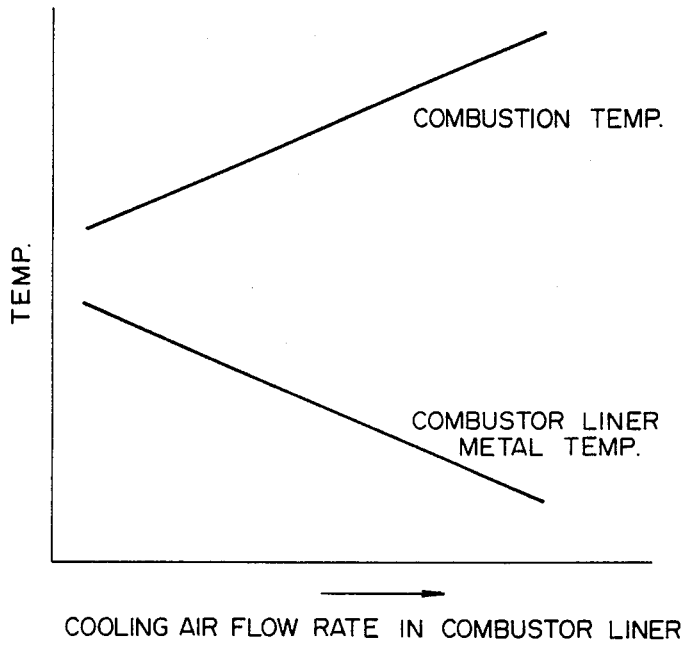
FIG. 8 is a graph showing a relationship among the cooling air flow rate, the combustor liner metal temperature and attainable combustion temperature.

The metal temperature of the combustor liner 3 largely depends upon the flow rate of the cooling fluid flowing through the combustor liner 3. The decrease of the flow rate will lead to the elevation of the metal temperature of the combustor liner. This relationship is shown in FIG. 8.

According to the conventional technique, to consume the cooling fluid for cooling the tail pipe 5, the consumption of 1% will cause the metal temperature of the combustor liner to be elevated by about 20° C. As a result, the combustion temperature within the combustor liner must be reduced corresponding to the metal temperature elevation. This is not desirable from a point of view of the gas turbine temperature elevation.

Also, in the thus constructed tail pipe 5, there is provided a tail pipe support boss **5*b* on the downstream side and there is provided the retainer ring 5*c* at the outlet portion of the tail pipe 5 as shown in Fig. 4. Since these portions are different in configuration from the other parts, there would be generated "high spots" of the metal temperature. In order to avoid the high spots, it is possible to flow the cooling fluid through through-holes formed in the tail pipe 5** to such an extent that the amount of the fluid flow would not affect the advantage of the foregoing embodiment.

Figure 9:
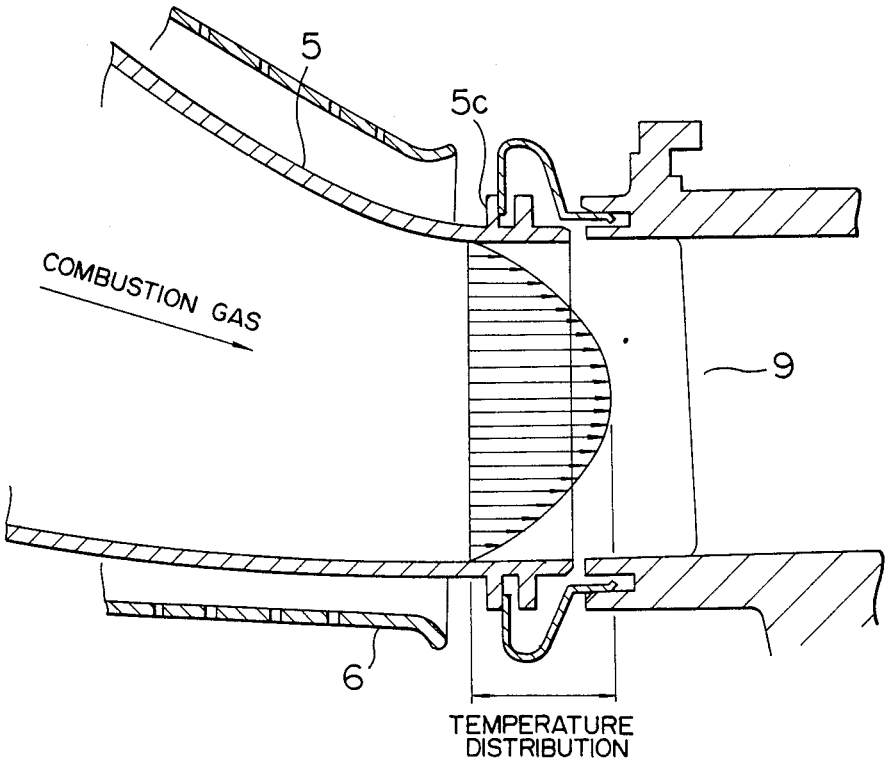
FIG. 9 shows a temperature distribution or gradient at the outlet of the gas turbine combustion apparatus.

The temperature distribution or gradient of the combustion apparatus will now be described with reference to FIG. 9. The combustion gas from the combustor liner is mixed with and agitated by the diluting air. The combustion gas is introduced into the combustor tail pipe 5 under the condition of the temperature difference from outside to inside. As the combustion gas flows from the inlet circular shape of the combustor tail pipe 5 to the outlet sector shape thereof, there is the temperature distribution or gradient where the temperature in the central portion is high while the temperature in the peripheral portion is low with respect to the radial direction and the circumferential direction. With such a temperature gradient, the combustion gas is introduced into the turbine 9. This temperature gradient would cause the high spots of the vane metal temperature against the turbine, which would be a factor of deterioration of reliability.

According to the conventional technique, in the case where the impingement air for cooling the tail pipe is introduced into the tail pipe through the through holes formed in the tail pipe, the peripheral portion that is kept at a lower temperature will be further cooled. Thus, corresponding to this temperature decrease, the temperature of the central portion that is kept at a higher temperature is further increased. This is caused by a constant exhaust gas temperature control for the gas turbine.

According to the present invention, since the cooling fluid is not made to flow through the tail pipe, such undesired phenomenon may be avoided and the temperature gradient may be suppressed to a minimum possible level.

We claim:

1. A gas turbine combustor apparatus comprising:

a cylindrical combustor liner having an outer wall in which cooling air holes are formed;

a fuel nozzle provided at a head of said combustor liner;

a tail pipe connected to an end of said combustion liner for introducing combustion gas, produced within said combustor liner, into a turbine portion;

a flow sleeve having a length substantially equal to said connected combustor liner and tail pipe and surrounding substantially over the full length of said connected combustor liner and tail pipe, with a radial gap between said flow sleeve and said connected combustor liner and tail pipe; and means for introducing cooling air into the gap between said flow sleeve and said tail pipe, said cooling air introducing means having a group of small holes formed in a first region of said flow sleeve close to said turbine portion, wherein said flow sleeve has a second region closer to said combustor liner than said frost region of the small holes, through holes being formed in said second region for introducing the cooling air.

* * * * *